United States Patent [19]

Tegart

[11] Patent Number: 4,798,385

[45] Date of Patent: Jan. 17, 1989

[54] DOUBLE ENDED GOLF COURSE

[76] Inventor: Harold G. Tegart, 9147 Foothill Blvd., Sunland, Calif. 91040

[21] Appl. No.: 20,563

[22] Filed: May 4, 1987

Related U.S. Application Data

[60] Division of Ser. No. 814,601, Dec. 30, 1985, Pat. No. 4,696,474, which is a continuation-in-part of Ser. No. 431,567, Sep. 30, 1982, Pat. No. 4,572,512.

[51] Int. Cl.[4] ..... A63B 69/36; A63B 67/02

[52] U.S. Cl. ..... 273/176 A

[58] Field of Search .... 273/176 A, 176 AB, 176 AA, 273/176 E, 176 F, 176 FA, 176 FB, 176 L, 176 R, 181 A, 186 RA, DIG. 28

[56] References Cited

U.S. PATENT DOCUMENTS 3,599,981 8/1971 Zausmer ..... 273/176 A 4,189,152 2/1980 Raber ..... 273/176 AB

*Primary Examiner*—George J. Marlo

*Attorney, Agent, or Firm*—John E. Wagner

[57] ABSTRACT

A compact golf course and method of play which employs a number of tee positions facing a series of targets at ranges up to 300 yards with distance indicators whereby a player at one of the tees can drive tee and fairway shots recording precisely the distance attained one each shot. Chipping greens are provided. Putting greens are provided for the putting phase of the golf game. The golfer moves in sequence from the tee and fairway target range to the chipping range and the putting greens. Score cards are provided and layouts of famous course appear on charts located at each tee position to allow the player to play in sequence the holes of the selected famous course. Television cameras are located in the tee and fairway driving range portion of the course. Player actuated supplemental lighting is provided. The method involves teeing and driving to match as closely as possible to the distance of the first hole of the course selected using the targets as an indicator of the range attained on each shot. When the player has reached within 50 yards of a target representing the distance to the pin on the hole of the course selected, he moves to the chipping range at the same distance remaining and chips to the chipping green. Thereafter, he moves to the putting green and puts out and records his strokes. An improved method of scoring provides a permanent record of distance and efficiency of each golf shot in progress, not just the number of strokes per hole as in conventional golf.

5 Claims, 4 Drawing Sheets

CHIPPING AND PITCHING AREA

THE CHIPPING AND PITCHING APEA, PPO-SHOP AND CLUB HOUSE LOCATED AT ADJACENT SELECTED APEA.

DOUBLE ENDED GOLF COURSE

REFERENCE TO RELATED APPLICATIONS

This application is a division of Ser. No. 814,601, filed Dec. 30, 1985, now U.S. Pat. No. 4,696,474, which is a continuation-in-part of Ser. No. 431,567, filed Sept. 30, 1982, now U.S. Pat. No. 4,572,512.

BACKGROUND OF THE INVENTION

With the overcrowded conditions of conventional golf courses, the expense of play and the time required to play a round of golf, a number of people have recognized the need for providing a compact form of golf course which is less expensive due to use of less land, allows multiple players to speed up the time and as a result of the two, reduces the cost to the golf player. A number of patents have issued for compact golf courses as a result. These patents include the following:

| U.S. Pat. No. | Issued | Inventor |
|---|---|---|
| 3,129,943 | April 21, 1964 | McKee |
| 3,310,310 | March 21, 1967 | McKee |
| 3,464,703 | Sept. 2, 1969 | Vallas |
| 3,685,832 | Aug. 22, 1972 | Johnson |
| 3,904,209 | Sept. 9, 1975 | Thomas |
| 3,999,764 | Dec. 28, 1976 | Nitsche |
| 4,019,748 | April 26, 1977 | Healey |
| 4,063,738 | Dec. 20, 1977 | Michalson |
| 4,129,300 | Dec. 12, 1978 | Magnuson |
| 4,129,510 | March 11, 1980 | Miller |
| 4,283,056 | Aug. 11, 1981 | Miller |

Each of these patents disclose golf courses requiring significantly less ground than a standard golf course, and often to varying degrees appear to achieve the objective of faster play and reduced cost.

It would appear from the study of these patents that many of them go to a great extent to simulate play of the golf course and may attempt to provide an atmosphere of isolation through the use of natural and artificial barriers between player tees providing a degree of simulation of play of a conventional golf course. While a number of these objectives have been attained, at least partially, the compact golf course has not reached any significant acceptance in the golf community as noted by their absence from thu modern day golf scene. In a typical metropolitan area, one will find public and private full size golf courses, par three or reduced yardage golf courses and driving ranges but this inventor has yet to see a single operating compact golf course of the type disclosed in the above patents. Recognizing the continuing need for compact golf courses and after further study of the features of the several disclosures, this inventor finds that his basic concept provides features not present in any prior compact golf course designs and in fact provides a game of golf which is superior in a number of respects to the conventional golf game.

BRIEF DESCRIPTION OF THE INVENTION

This inventor has, he believes, eliminated some of the inherent weaknesses in the prior attempts to attain a satisfactory compact golf course and to provide a more interesting play than even conventional golf. He employs a generally rectangular course of variable dimensions and having as a typical size 100 yards in width by 400 yards in length exclusive of service, club house and parking areas. The layout is generally rectangular which makes it most adaptable to available real estate but is not limited to such a shape. The layout includes a number, for example 10 tees, each directed toward a fairway of at least 300 yards in length and 100 yards in width. A number of yardage indicators which may be in the form of yard lines are provided as well as targets at varying ranges from 40 to 300 yards. The targets may take the form of a simulated green and pin. Hazards on the fairway are provided and an out-of-bound line on each side of the fairway is present. Within short walking distance of the tees are a plurality of pitching greens with arcuate lines defining varying distances from the pitching green, namely 50 to 20 yards. One or more putting greens are also provided. A number of television cameras are directed at the fairway allowing the player to follow and locate his ball in flight and on landing in order to properly record its range. A closed circuit television receiver is located at each tee for viewing by players in observing their balls.

An improved water hazard is also disclosed as well as an improved tee station.

In accordance with the method of this invention, the player is given a number of distinctive balls sufficient for a round of 9 or 18 holes. He selects a particular course which he intends to simulate playing and records the yardage for each of the holes of the round on a score card. A player drives his first tee shot and records the distance attained and any penalty if he enters a trap or lands out of bounds. He subtracts the yardage attained from the yardage remaining on the first hole of his selected course and takes his second or fairway shot and again subtracts yardage attained from the remaining yardage to the first hole. When his ball lands 50 yards or less from a traget pin he moves to the chipping pitching green 'C' at the appropriate distance on the arcuate play areas and chips or pitches to the green 'C' by recording each shot numerically. If he lands on the target green 'P' in his fairway play, he moves to the putting green to putt out and records his play for the hole. He and his playing partners return to the tee reserved to them, and proceed to play the next hole in like manner. The play may be by a foursome, threesome, pair of single player without affecting performance. The score card reflects not only the number of strokes required for each hole but also the yardage and quality of shot obtained for each fairway club used and the number of putts. Alternate embodiments involve a double ended course and a trapezoidal shaped course.

BRIEF DESCRIPTION OF THE DRAWING

This invention may be more clearly understood from the following detailed description and by reference to the drawings in which.

DETAILED DESCRIPTION OF THE INVENTION

Figure 1:
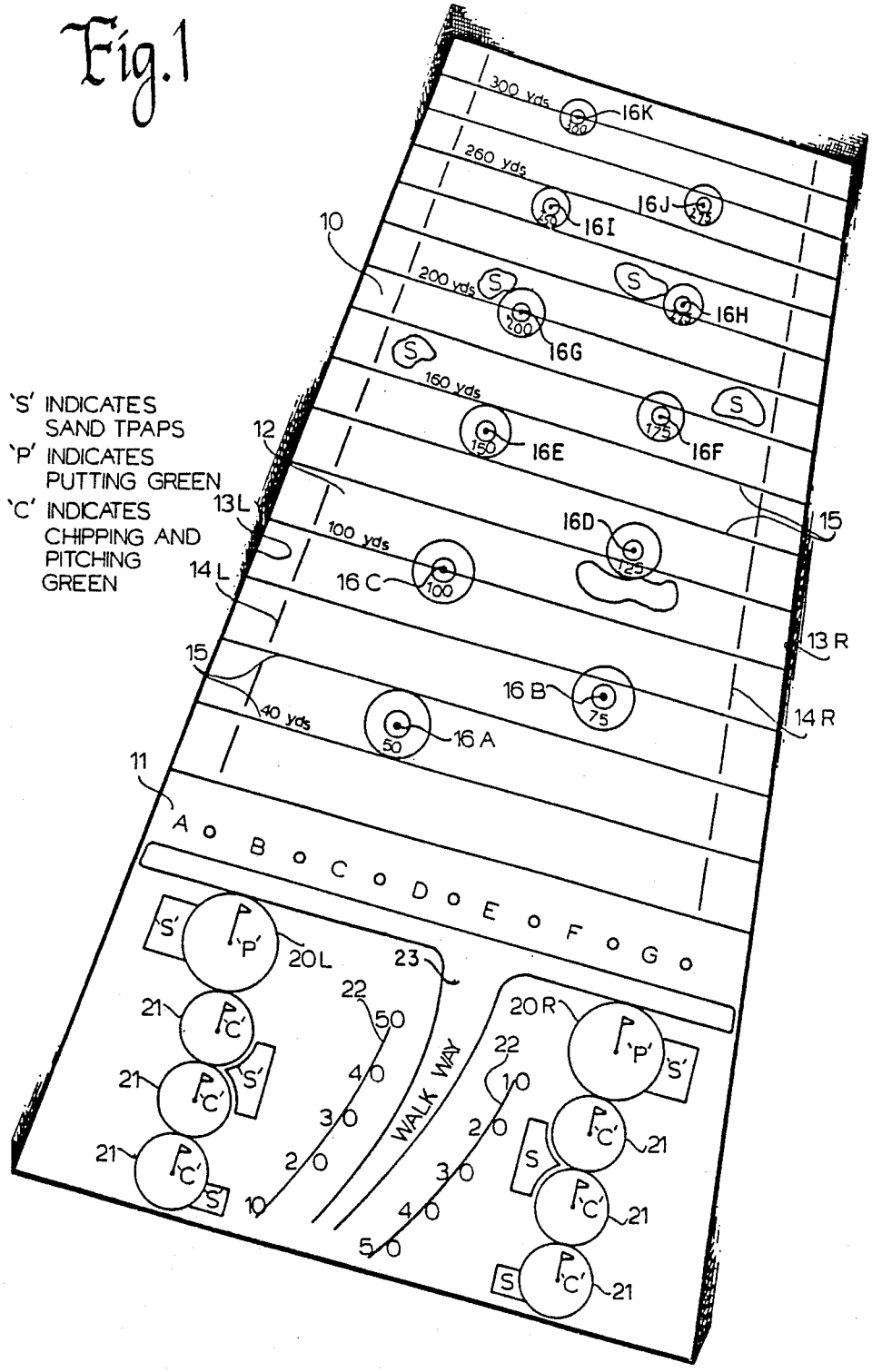
FIG. 1 is a perspective view of a compact golf course in accordance with this invention.

Now for a clear understanding of this invention, attention is directed toward FIG. 1 which provides somewhat of an aerial view of the basic elements of this invention excluding club house, service area and parking. The compace golf course in accordance with this invention generally designated 10, comprises a tee area 11 including a number of individual tees designated A–G for convenience. The tees face a fairway generally designated 12 including perimeter fences denoted by lines 13L and 13R and out of bound lines 14L and 14R. We have a number of yardage indicators shown for convenience as yardage lines 15, preferably located at 20 yard intervals from the tees 11. Also present in the fairway are a plurality of targets 16A through 16K. The targets are shown 11 in number, however there is nothing critical about the particular number or location of the targets other than that they are at varying distances from the tees in the fairway. A number of sand traps designated S and one or more water hazards designated W are present in the fairway to provide natural hazards in play. The rough strip designated in FIGS. 2A and 3 as ROUGH regions are preferably mowed at a higher level than the fairway to accurately represent rough.

In FIG. 1 shown to the rear or adjacent to the tees 11 but located at any place in the region are a pair of putting greens 20L and 20R designated by the letters P and a number of chipping pitching greens 21 designated by the letter C. The chipping pitching greens 21 are preferably located at the side perimeter of the property of the course and between the chipping pitching greens 21L to the left and 21R to the right. In FIG. 1 is a central walkway 23 from the tee area along a curved arc and a number of chipping positions 22 at varying distances from the several, for example, 6 chipping greens 21. The curved chipping lines 22 allow the players to position themselves at any correct distance from the chipping pin corresponding to the remaining distance after his last fairway shot. If his remaining distance was about 43 yards, he positions himself along the left chipping line 22, slightly closer to the 40 indicator than the 50 yard mark. The large number of chipping greens and the continuously variable chipping distances allows a number of players to chip or pitch simultaneously without interference with each other. Adjacent to the chipping pitching greens 21 are the putting greens 20L and 20R, either of which the player may use. As shown in FIG. 1, the putting greens 'P' are located near the tees 11 as is usually found in conventional full courses but the location of the greens may be moved to accommodate the particular terrain in which the course is located.

Figure 2:
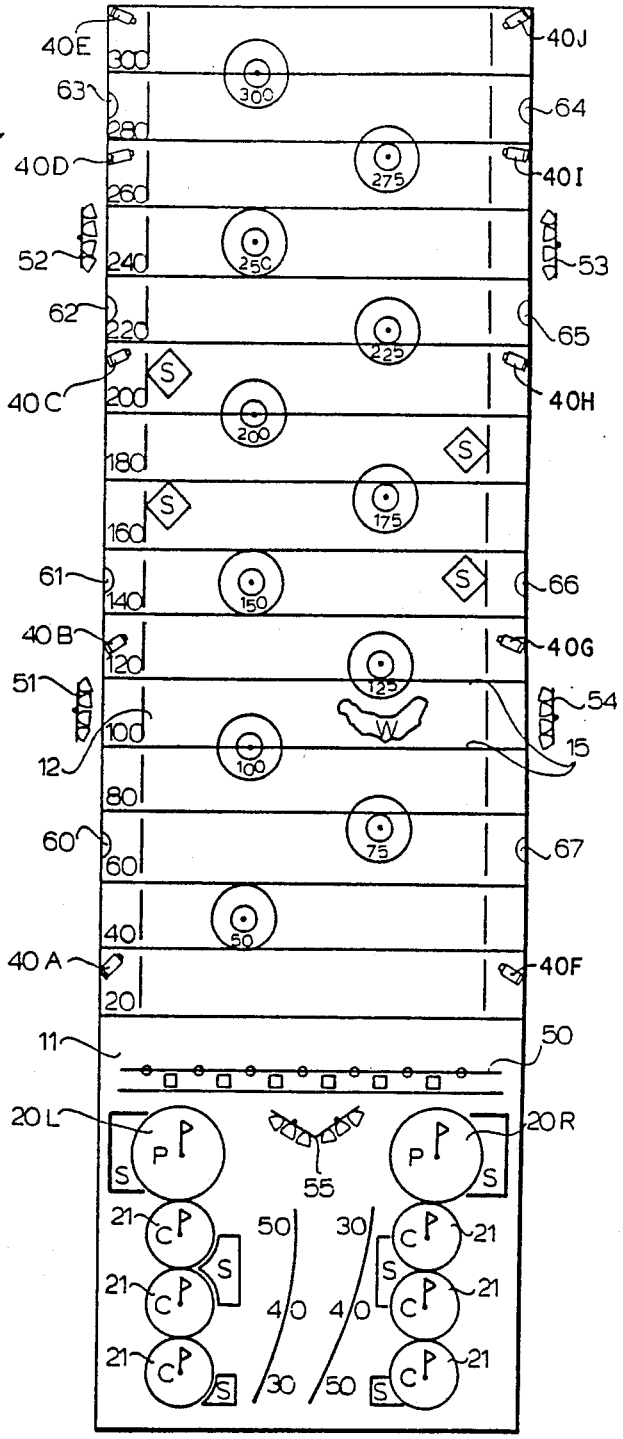
FIG. 2 is a plan view thereof.
Figure 2A:
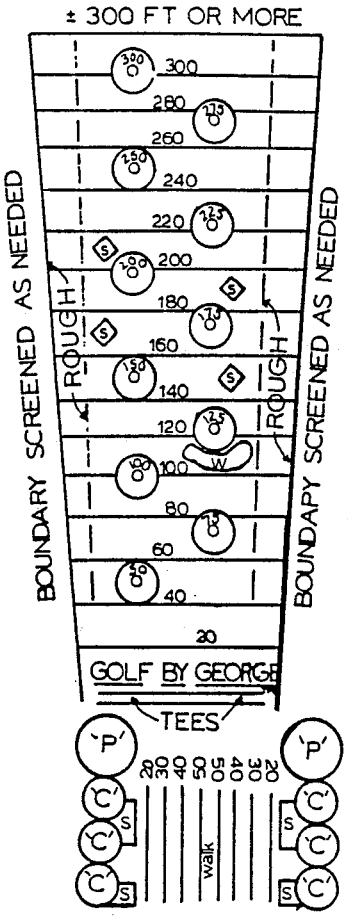
FIG. 2A is a plan view of an alternate trapezoidal embodiment of this invention.

Now referring to FIG. 2, two other aspects of this invention may be seen. The addition to the tees 11, yardage lines 15, and greens 20 and 21, the fairway targets 16A–K may be seen more clearly. They each include a pin or flag and are located at 25 yard range intervals from the tee line 11. The target greens 16 are 20 yards in radius and include an outer circle of a 10 yard radius and an inner circle of 3 yards.

Certain other features of this invention may also be seen in FIG. 2. A number of closed circuit television cameras 40 are located at the side of the fairway 12 with suitable protection from stray balls and are directed toward the fairway 12. The cameras 40 cover the fairway region so that any one camera will be no greater than 60 yards from any ball lie. The cameras 40 aid the player in picking out his ball, and in accurately determining the distance of each shot. The closed circuit television cameras give him an accurate view of the ball location. The cameras may have zoom capability and in such case where controls are available to the player, he may have a quite close look at his ball. Since it is the practice of using distinctively marked balls for each player, the identification of a player's ball is even easier with the television cameras. As shown in FIG. 2, a total of 10 television cameras are used but this number may very depending upon the requirements of the particular course.

Figure 6:
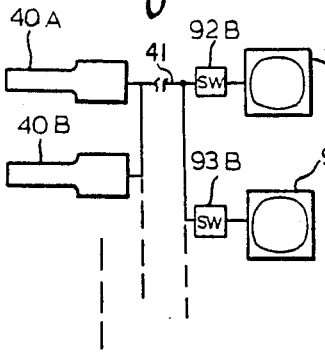
FIG. 6 is a simplified block diagram of the closed circuit television system of this invention.

FIG. 6 shows a simplified block diagram of the television camera and monitor system. The several cameras 40 are all connected by cables 41 to each of the tees. A selector switch 92B, 93B etc. allows players to connect any of the cameras to the local monitor 92 of FIG. 4.

Figure 4:
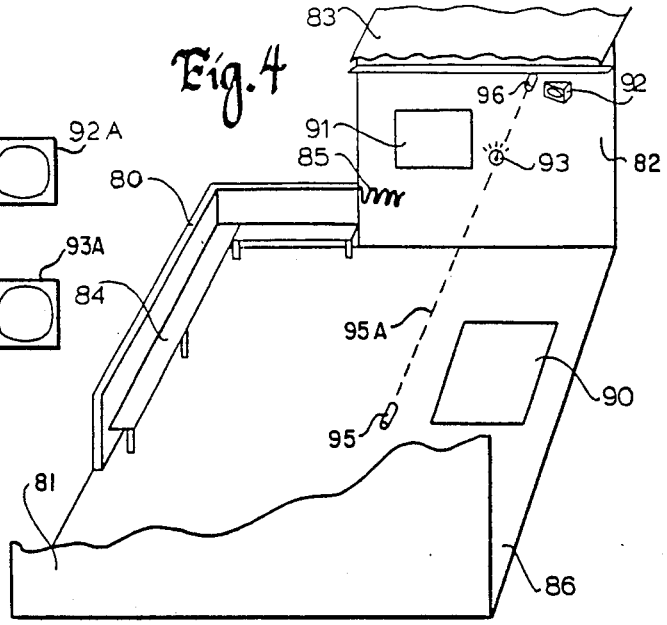
FIG. 4 is a fragmentary perspective view of a single tee.
Figure 7:
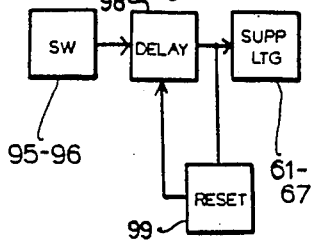
FIG. 7 is a simplified block diagram of the supplemental lighting visual aid system of this invention.

FIG. 2 also shows a basic lighting system used for night play and a supplemental play actuated visual aid lighting system is shown in FIGS. 4 and 7. The basic lighting system includes drop or fluorescent lighting at each tee designated 50 and banks of elevated flood lights 51–54 directed at the fairway 12 and 55 directed at the chipping and putting greens.

Figure 3:
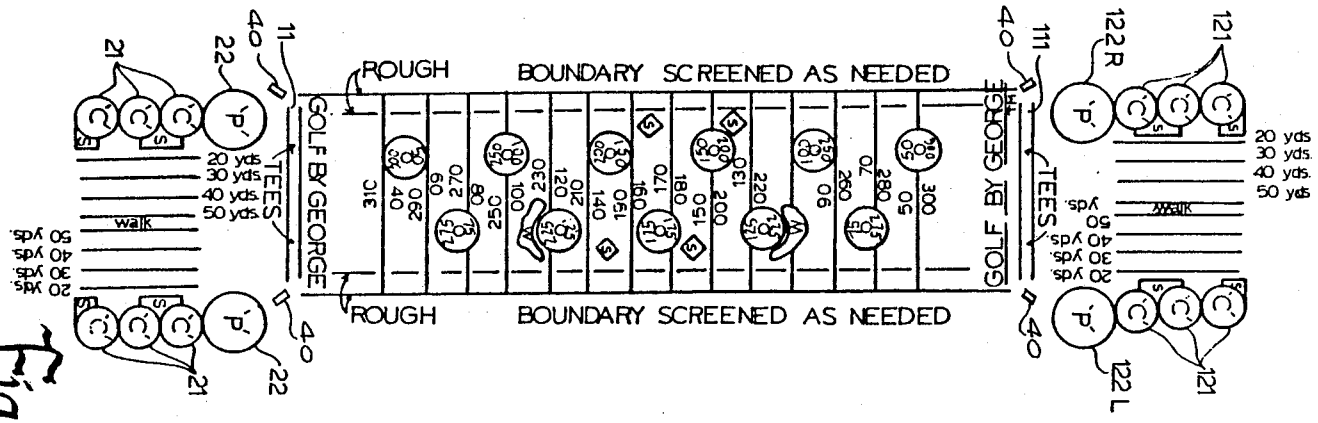
FIG. 3 is an alternate embodiment double ended layout of this invention.

FIG. 3 shows an alternate embodiment of this invention which is double-ended. In FIG. 3 the same or slightly longer fairway 12 is used than in the case of FIG. 1. This embodiment differs in that an additional set of tees 111, chipping greens 121 and putting greens 122 are present at the opposite end of fairway 12. The fairway range markers 15 bear designations indicating the distance from either end, usually visible from one end only. The targets 16 also bear dual distance designations to be observed by the golfer at the tees and by the cameras.

This version of my invention, requiring only about 20 percent additional real estate, increases the number of tees by 100 percent. Each of the other features of this invention remain in the embodiment of FIG. 3.

Referring now to FIG. 4, one form of tee may be seen in the form of a booth generally designated 80 including boundary side walls 81 and 82 which form common walls with adjoining tee booths. The booths 80 are preferably covered by a roof 83 for sun and rain protection for the players. A bench 84 is provided for other members of the player's party and rack 85 for golf bags may be present. The front of the booth 80 includes some form of turf 86, either natural or artificial for fairway shots. It also receives golf tees for tee shots. A central tee region 90, similar to driving ranges may be provided or the entire front area may be of turf.

The booth 80 also includes a course layout board 91, preferably attached to the wall 82 and having a number of large layouts for prominent courses of the world. The players may select the course to simulate play and display the appropriate layout on the wall throughout play. Where such course will include unusual hazards, the precision needed to play such courses is simulated in this invention by the targets 16 toward which all tee and fairway shots should be directed. Thus, the presence of targets on the fairway adds a new dimension to the game of golf by providing a value measure for each shot as well as mere range and position. Accuracy also is a factor in this game.

I have provided closed circuit television for monitoring the flight and position of the ball. This is in the form of the television cameras 40 a–j of FIG. 2 and the television monitor 92 of FIG. 4. The monitor 92 is located in the booth at an elevated position, out of playing areas and generally in the line of the player's normal field of view when tracking the flight of his ball. The elevated position shown in FIG. 4 is desirable for booths generally to the right of the centerline of the course. Other locations may, of course, be selected to provide the best view for the players. Since a number of television cameras are in operation and only one or two will give the best view of the ball's flight, a channel selector switch 93 is provided to allow the players to select the appropriate camera. This may be done before taking the shot if the player's shot is predictable or immediately after the shot while the ball is in flight.

Under conditions of night play, normal lighting may be insufficient to provide a clear image in the television system. In such case the supplemental lighting system of FIG. 2 is energized for a period approximating the longest flight and sufficient time to follow the roll and clearly identify and locate the player's ball. This is done employing the play actuated switch of this invention. In its preferred form the play activated switch includes a light source 95 secured overhead to wall 81 and a photo electric cell 96 secured in alignment with the light source on the opposite wall 82. Located overhead above the player's head the passage of the club through the light path 95A interrupts the light beam and triggers the supplemental lighting just as the player completes his stroke.

The play actuated lighting system appears in FIG. 7. It comprises a play actuated switch such as the combination of light source 95 and photocell 96 located in each booth. This switch combination acts through a delay device such as a slow acting relay 98 to light the supplemental lighting system 60–67. After a predetermined period of time, e.g. 16 seconds, a reset circuit 99 extinguishes the supplemental lighting unless a second golfer has again energized the system.

Figure 5:
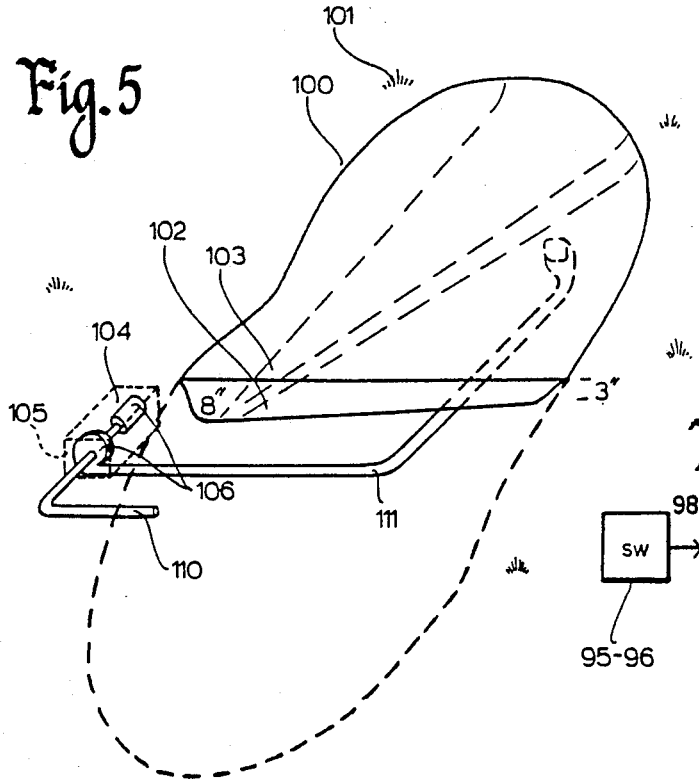
FIG. 5 is a sectioned perspective view of a novel water hazard in accordance with this invention.

FIG. 5 shows an improved form of hazard which is directly applicable to this course or may be used on a conventional course as well. It is a shallow lake water hazard having a solid bottom such as gunite type concrete. The water hazard, generally designated 100, is located in the fairway 101 and gives the same general appearance as a natural water hazard. It is, however, only a few inches deep and has a hard yet resilient bottom 102, preferably of concrete. The depth varies from 3 to 8 inches in my preferred embodiment. The lake or water hazard 100 may be static with just makeup water added to maintain the level of water between 3 and 8 inches in depth or it may include a recirculating system 104 as disclosed in FIG. 5 including a pump and motor combination in an equipment vault 105 indicated in dashed lines, supply 110 and return 111 lines.

The tapered bottom of the water hazard 100 allows balls which land and remain in the trap to roll along the bottom to a collection point for ease of recovery. Balls may be easily seen and recovered when the course is not in use. In conventional courses ball recovery using my improved water hazard may occur during play without disturbing other players because of the shallow depth and normal bottom visibility which allows recovery of the ball in just a few seconds. Standard mobile ball retrieving equipment may collect balls by driving through the hazard.

Anytime a ball hits the water of a water hazard, the golfer marks "W" on his score card where he records the length of that shot, and counts one stroke penalty. His yardage is that at where his ball hits the water.

THE METHOD OF PLAY

The method of play in accordance with this invention involves the player or players registering and receiving a fixed number of balls; usually distinctively each marked and entering the tee booth or tee position. The course to simulate play is selected and the course layout posted for reference and to add to the atmosphere of the course.

The golfer selects the course he wishes to simulate play for that round. He notes on his scorecard the name of the course he has selected and the distance and par of each hole for that course before he begins play.

Example: Hole No. 1 - 385 yards. After teeing off, the golfer records the yardage he has advanced the ball in his first shot. (He ascertains this with the aid of the closed circuit TV and the monitor located at this tee, and the location of his ball in relation to the marked off, horizontal yardage lines visible to him and the closed circuit TV.) (Target greens and circles are not yet involved.)

The yardage recorded must be that determined where the ball lies in relation to the horizontal yardage lines, at 20 yard intervals, across the fairway. If his drive was a sharp slice to the right, he may have hit his ball actually longer, due to the angle, but he only records the yardage he has advanced the ball up the fairway. The added length he hit it off to one side is lost as a penalty for mis-hitting it. Example: His observed yardage for his drive was 170 yards. He notes the 170 yards on his scorecard and subtracts that from the 385 yards, leaving 215 yards for his second fairway shot.

All fairway shots are made from his tee, which remains reserved to him and his playing pertners, until the round is completed.

For his second fairway shot he selects the fairway target green (which now becomes involved in the play) which distance from the tee is at the closest yardage that is greater than 215 yards. Therefore, the 225 yard target green would become his target for his second shot. He selects the appropriate club for that distance.

He than plays a second ball from the his toward the 225-yard target green and observes with the aid of the closed circuit TV the yardage he has advanced the ball. (Again, this will be the yardage location where his second ball comes to rest between the horizontal yardage lines located across the fairway.) He may have hooked a long ball off to the left—but only records the yardage where his ball lies in relation to the yardage lines; this being the yardage his second shot has further advanced the ball directly forward.

Assume his second shot is 183 yards. He notes same on his scorecard below the 225 yards he previously noted and subtracts the 183 yards from the 225 yards, leaving a distance of 42 yards.

If he has missed his target green but has hit within 50 yards of his target green, (at any location around the hole) and if still off the green he observes the yardage from that hole and notes that distance on his scorecard.

He then proceeds to the chipping-pitching greens "C" approach area.

He places either his own or a specially marked ball in the adjacent 'C' approach on one of the 2 sets of 'Yardage Lines' at the location along the line that corresponds with the distance he has missed his target green. He then chips or pitches onto the 'C' green and putts out.

If he has reached the fairway target green he notes on his scorecard only the observed distance in yards that the ball is from the pin.

He then proceeds to the 'P' Putting Green, places either his own ball, or a specially marked course ball at that noted yardage or 3 foot strides from a hole on the 'P' Putting Green, putts out and records his total strokes for that hole on his scorecard.

He than walks back to the tee reserved for him, and plays the remaining holes in like manner.

All lengths of distance are measured in yards, or 3 foot strides.

If, during the fairway play, he lands in a fairway sand trap, he marks 'S' on his scorecard next to the noted stroked distance when he went into the trap. He continues his fairway play as though he had not gone into the trap. However, after he has reached within 50 yards of his fairway Target Green, but missed it, he proceeds to the Chipping-Pitching Greens, places his or her special ball at his last remaining yardage from the Chipping-Pitching Green pin. He must then chip or pitch into the trap that is adjacent to the Chipping-Pitching Green 'C', play from the trap onto the Chipping-Pitching green 'C' and putt out.

If he has an 'S' during his fairway play,and does not miss his Target Green, he must first toss his ball into the sand trap adjacent to the Putting Green 'P' and play out onto the putting green 'P', and putt out, recording his total strokes on that hole.

If he misses his Target Green and lands in the adjacent sand trap, then at the putting green 'P' he must first toss his ball into the sand trap 'S' and play out onto the putting green 'P' and putt out. When a golfer's ball lands in the rough, he plays his next ball at this tee, off of the rough pad.

If the ball lands in a water trap, he marks a small 'w' on his scorecard next to the noted stroked distance and counts one stroke penalty.

When the ball hits a side boundary, he marks a small 'b' on his scorecard next to the noted stroked distance for that hole, and he takes a two stroke penalty.

Following this procedure, the full round of golf proceeds for each player.

The above described embodiments of this invention are merely descriptive of its principles and are not to be considered limiting. The scope of this invention instead shall be determined from the scope of the following claims, including their equivalents.

I claim:

1. A double ended compact golf course comprising a common fairway region of at least 300 yards in length;
   - a plurality of range markers positioned along said common fairway region, at least some of said range markers visible to players at each end of said double ended compact golf course;
   - a set of tees, each located at opposite ends of said common fairway region and aimed thereat;
   - the range markers of said common fairway region positioned to display the range from each of the sets of tees;
   - target means on said common fairway region for the golfers at each end of said double ended compact golf course; and
   - actual greens adjacent to said tees at each end of said fairway region for chipping and putting after completion of fairway play.

2. The combination in accordance with claim 1 wherein said common fairway region is generally retangular in shape and includes out-of-bounds along each side therof.

3. A double ended compact golf course in accordance with claim 1 including a plurality of sets of chipping and putting greens, one set accessible to tees at each one of said ends.

4. A double ended compact golf course in accordance with claim 1 including range markers bearing dual distance designations on opposite sides thereof and visible to golfers at said tees and closed circuit television cameras located at the opposite ends of the common fairway region and directed at said common fairway region and the range markers.

5. A double ended compact golf course in accordance with claim 1 including target greens bearing dual distance designations visible to golfers at said tees and including closed circuit television cameras located at the opposite ends of the common fairway region; and
   - closed circuit television monitors at the respective tees.

* * * * *